US005632418A

United States Patent [19]

Brown

[11] Patent Number: 5,632,418

[45] Date of Patent: May 27, 1997

[54] SOAP DISPENSER FOR SECURE MOUNTING ON WALL PLATE

[76] Inventor: Danial F. Brown, 2555 Camelot Way, Reno, Nev. 89509

[21] Appl. No.: 504,423

[22] Filed: Jul. 20, 1995

Related U.S. Application Data

[63] Continuation-in-part of Ser. No. 389,763, Feb. 16, 1995, abandoned.

[51] Int. Cl.[6] ..... B67D 5/06

[52] U.S. Cl. ..... 222/180; 222/153.09

[58] Field of Search ..... 222/181.2, 181.3, 222/153.09, 180, 321.7

[56] References Cited

U.S. PATENT DOCUMENTS

| | | | |
|---|---|---|---|
| 3,768,684 | 10/1973 | Buchtel | 222/181.3 X |
| 4,164,306 | 8/1979 | Perrin | 222/181.2 |
| 4,441,638 | 4/1984 | Shimano | 224/35 |
| 4,582,227 | 4/1986 | Kanfer | 222/153 |
| 4,651,902 | 3/1987 | Hobbs et al. | 222/153 |
| 4,789,017 | 12/1988 | Panasewicz et al. | 141/342 |
| 5,105,990 | 4/1992 | Leith | 222/181.2 X |
| 5,238,160 | 8/1993 | Faulds | 224/32 |

*Primary Examiner*—Gregory L. Huson

*Attorney, Agent, or Firm*—David H. T. Wayment

[57] ABSTRACT

A mountable soap bottle with cavities which engage arms on the mounting plate. The soap bottle can be securely mounted to the plate and pump top on the soap bottle can be securely fastened to the bottle so as to resist tampering or pilferage.

5 Claims, 3 Drawing Sheets

FIG. 11
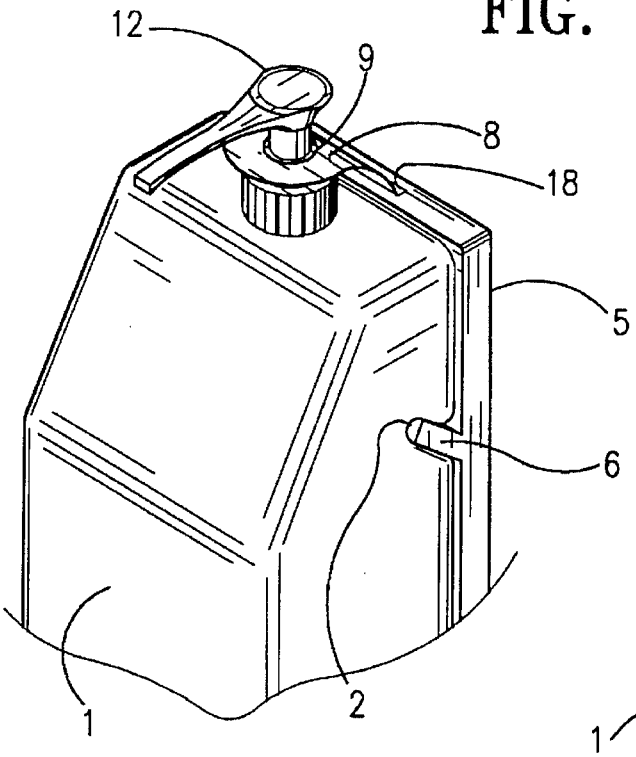
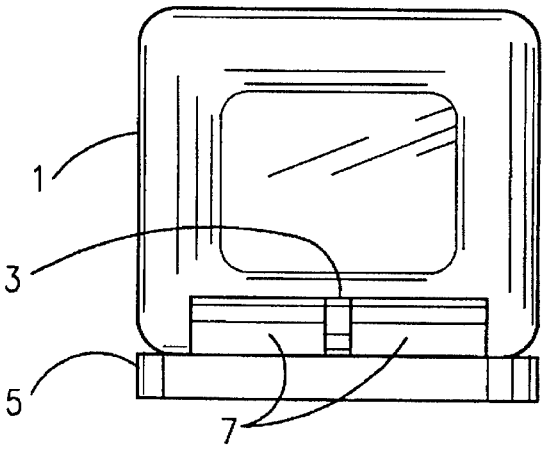
FIG.12
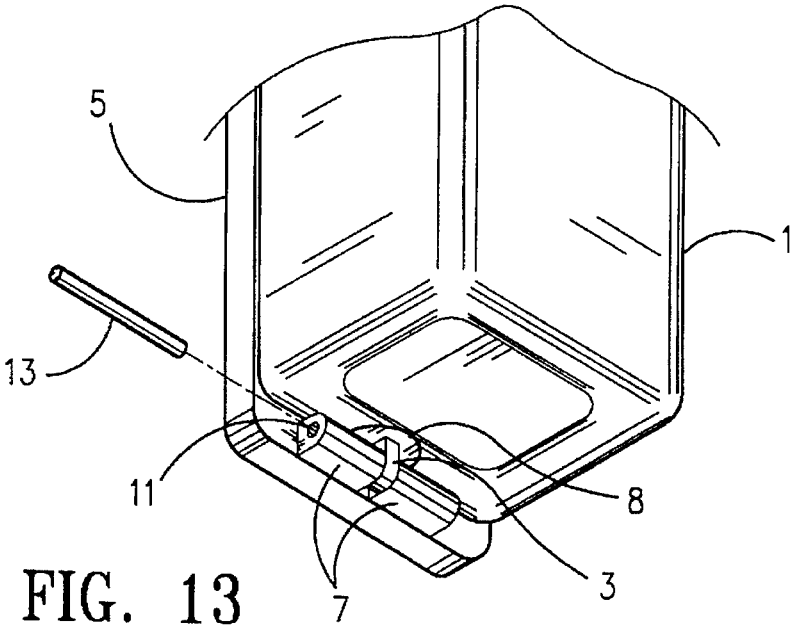
FIG. 13

SOAP DISPENSER FOR SECURE MOUNTING ON WALL PLATE

CROSS REFERENCES

This application is a continuation in part of application Ser. No. 08/389,763, filed Feb. 16, 1995, entitled Detachably Mounted Receptacle with Locking Means, now abandoned, and which is incorporated herein by this reference.

BACKGROUND OF THE INVENTION

1. Field of the Invention.

This invention relates generally to containers for dispensing liquids and, specifically, to containers for dispensing viscous liquids such as soap.

2. Description of Related Art.

Containers for dispensing viscous liquids, such as soap, which can be mounted on a wall are well known in the prior art. Examples are Kanfer, U.S. Pat. No. 4,582,227, and Hobbs et aL, U.S. Pat. No. 4,651,902. While the prior art is fine for many applications, it has the drawback of not providing a simple, effective means for securely attaching the soap container to the mounting system in a way which will defeat efforts to tamper with either the container or the soap. The prior art also has the drawback of requiring a separate housing which attaches to the mounting system and holds the soap container in place.

In recent years, product tampering and pilfering, and the fear of tampering and pilfering, have grown dramatically. Typically, mountable soap dispensers which have attempted to provide some type of security have relied on encasing the soap container in a housing of rigid plastic and installing some type of locking mechanism on the housing. Although serviceable, this type of arrangement is costly and complicates the task of servicing the soap containers.

This invention is designed so that the container for the soap is integrated with the housing mechanism; in other words, the housing mechanism is the container. Further, the container is blow molded from an inexpensive plastic, such as high density poly-ethylene (HDPE), rather than the expensive, rigid plastics which characterize the prior art. The use of HDPE and blow molding for the container has the additional advantage that the container can be manufactured at a very low cost, which makes it economically feasible to discard the container when it is empty and replace it with a new container full of soap. With the prior art, the expensive containers are typically refilled when empty. The refilling of the prior art containers creates a risk of contamination from micro-organisms which are never really disposed of because old soap and new soap are always being mixed.

For the foregoing reasons, there is a need for a mountable container for viscous liquids, such as soap, where the shape of the container provides the mounting surface, thus eliminating the need for an external housing, and where the container can be secured to a mounting bracket in a way that makes the container and its contents resistant to tampering and pilferage, and where the container is inexpensive enough that it can be disposed of and replaced when empty.

SUMMARY

The present invention is directed to a mountable container for viscous liquids which satisfies the foregoing needs. A container having the features of the present invention comprises a plastic bottle equipped with a pump top, a mounting plate which is permanently attached to a wall where arms on the plate fit into cavities or depressions in the bottle, hollow cylinders near the bottom edge of the plate with a gap between the cylinders which can receive an eyelet on the bottom of the bottle, and a rod which passes through the cylinders and the eyelet, thus securely locking the bottle to the plate, and a strap which attaches to the eyelet and to the pump top thus locking the pump top to the bottle.

To the accomplishment of the above and related objects, features, aspects, and advantages, this invention may be embodied in the form illustrated in the accompanying drawings, attention being called to the fact, however, that the drawings are illustrative only, and that changes may be made in the specific construction illustrated and described within the scope of the claims.

BRIEF DESCRIPTION OF THE DRAWINGS

FIG. 11, is a perspective view of a version of the invention showing the strap emerging from a slot cut into the mounting plate.

FIG. 12, is a bottom plan view of a version of the invention showing how the eyelet on the container fits into the gap between the cylinders.

FIG. 13, is a bottom perspective view a version of the invention, showing how the strap fits over the eyelet on the container, and further showing how the rod is inserted into the hollow cylinders.

DESCRIPTION OF THE PREFERRED EMBODIMENT

The figures show a container, indicated generally by the number 1, which is produced from a flexible, light-weight plastic, preferably by the process of blow molding. The container, 1, is shaped so that the top of the container has a threaded neck which can engage a pump top, 12. The pump top is intended to be a conventional spring loaded pump, of a type well known in this art, and any suitable pump of this general type may be used. The container has cavities, 2, or recesses molded into the rear surface of the container, and an eyelet, 3, with a hole, 4.

The figures further show a mounting plate, 5, with arms, 6, which are suitable for engaging the cavities, 2, in the container, 1. It is intended that the mounting plate, 5, be permanently mounted to a suitable stationary, vertical surface, such as a wall. The plate, 5, also has a pair of hollow cylinders, 7, disposed near the bottom edge of the plate, 5, and placed in such a way that the eyelet, 3, will just fit between the cylinders, 7. As shown by the drawings, the cylinders, 7, are truly cylindrical over only a portion of their surface. The overall shape of the cylinders, 7, is not critical so long as the passage, 11, is capable of receiving the rod, 13.

The figures further show a strap, 8, which has an opening, 9, at one end which will fit over the pump top, 12, but where the opening, 9, is sized so that the pump top, 12, cannot pass completely through the opening, 9. The other end of the strap, 8, has an opening which will just fit over the eyelet, 3, in the container, 1.

Figure 1:
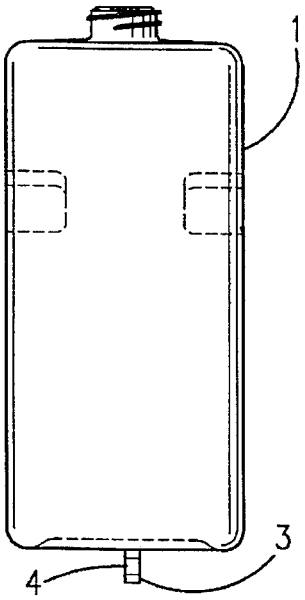
FIG. 1 is a front plan view of the container, shown with the pump removed.
Figure 2:
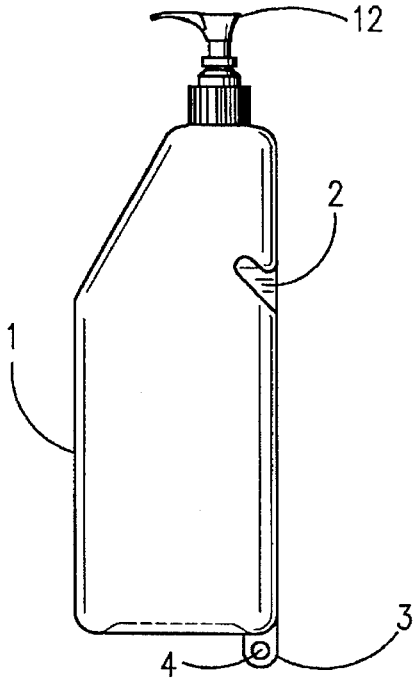
FIG. 2, is a side elevational view of the container with the pump top installed.
Figure 3:
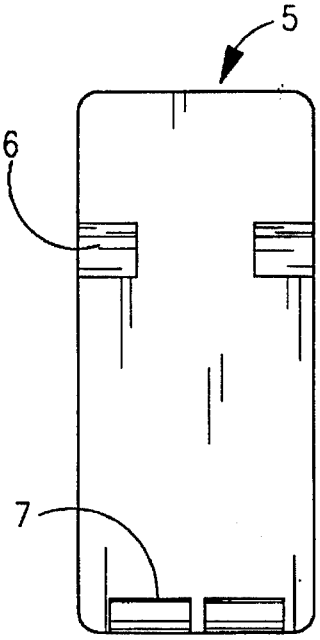
FIG. 3, is a front elevational view of the mounting plate.
Figure 4:
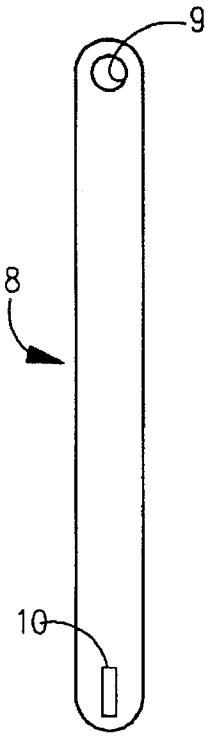
FIG. 4, is a plan view of the strap.
Figure 5:
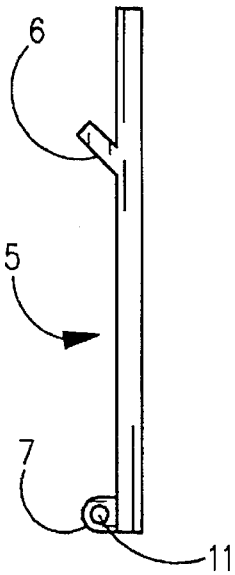
FIG. 5, is a side elevational view of the mounting plate.
Figure 6:
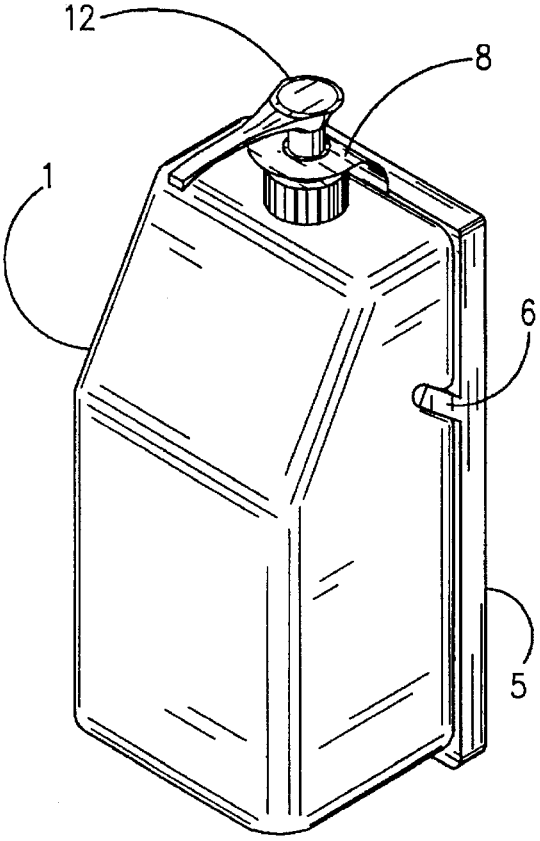
FIG. 6, is a perspective view showing the bottle mounted on the plate and also showing the strap fitted over the pump top.
Figure 7:
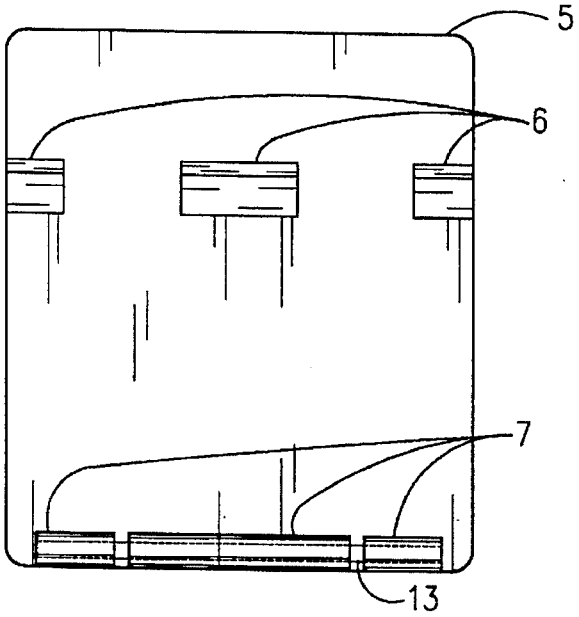
FIG. 7, is a front elevational view of a version of the plate allowing two bottles to be mounted side by side, showing a rod passing through the hollow cylinders which are disposed near the bottom edge of the plate.
Figure 8:
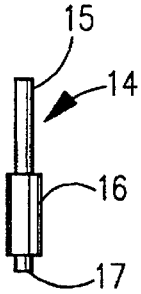
FIG. 8, is an elevational view of a key which allows for the adjustment or removal of the rod.
Figure 9:
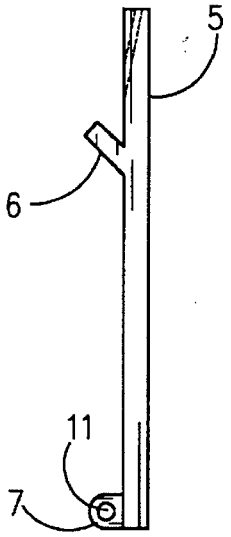
FIG. 9, is a side elevational view of the embodiment of the invention for multiple bottles.
Figure 10:
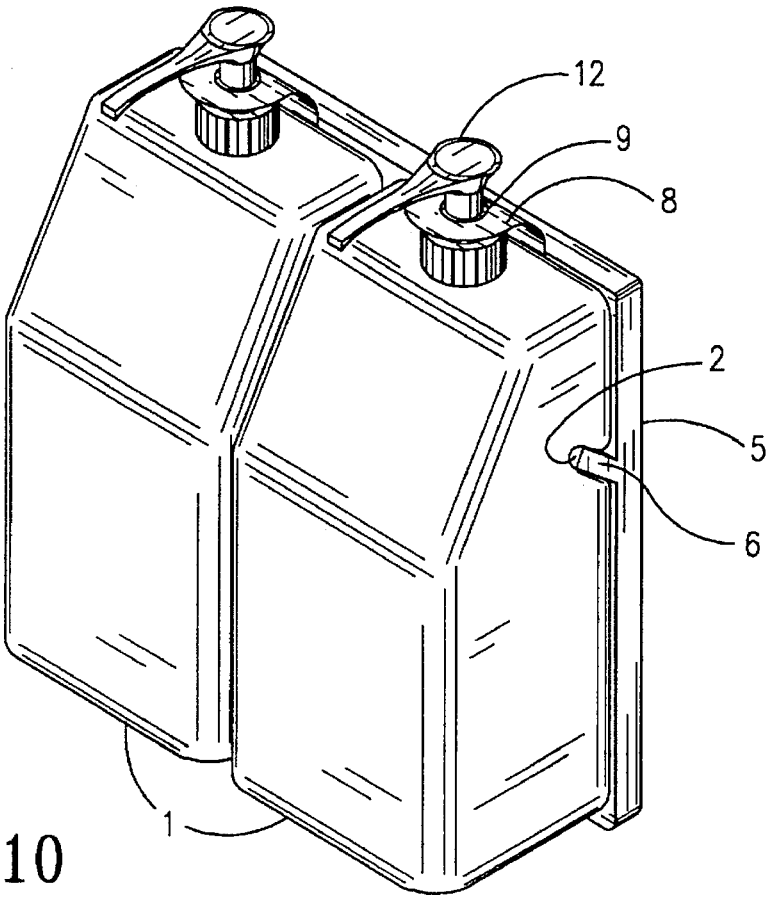
FIG. 10, is a perspective view of the version of the invention for multiple bottles.

FIGS. 7–10 show a version of the invention with multiple containers mounted on a single mounting plate. FIG. 8, shows a cylindrical plastic key, 14, which can be used to insert, adjust or remove the rod, 13, from the hollow cylinders, 7. The key, 14, has a handle portion, 16, a long end, 15, for removing the rod, 13, and a short end, 17, for ease in making adjustments to the rod, 13. The key, 14, must be shaped and sized to fit into the passage, 11. More specifically, the rod, 13, should be shorter than the distance between the outermost ends of the cylinders by a distance which is twice the length of the short end, 17, of the key, 14. In this way, if the short end, 17, of the key, 14, is used to adjust the rod, 13, both ends of the rod, 13, will be entirely within the hollow cylinders, 7, by an equal distance.

FIG. 11, shows a version of the invention where the plate, 5, has a slot, 18, cut into the upper edge of the plate, 5, which allows the strap, 8, to pass through the slot, 18.

FIGS. 12 and 13 illustrate the functioning of the hollow cylinders, 7, the rod, 13, and the flexible strap, 8. It is intended that the plate, 5, cylinders, 7, and rod, 13, all be made of a hard plastic, such as acrylic or polycarbonate, while the flexible strap, 8, and bottle, 1, should be made of a durable, flexible plastic such as high density polyethelene. Any of the plastics can be clear or translucent, or else a solid color, depending on the aesthetic needs of the end user.

To mount the container, 1, the end user will add soap, or some other viscous liquid, to the container, 1, screw the standard pump top, 12, onto the container, 1, place one end of the flexible strap, 8, so that the hole 9, fits over the top of the pump top, 12, place the other hole, 10, over the eyelet, 3, place the container, 1, on mounting plate, 5, so that the cavities, 2, engage the arms, 6, and the eyelet, 3, is between the hollow cylinders, 7, and finally, place the rod, 13, through the passage, 11, in the hollow cylinders, 7, using the key, 14, for final adjustments. It is anticipated that the end user will have permanently mounted the mounting plate, 5, on a solid vertical surface, such as a wall, before mounting the container, 1.

Each of the elements described above, or two or more together, may also find a useful application in other types of methods differing from the type described above. While certain novel features of this invention have been shown and described and are pointed out in the annexed claims, it is not intended to be limited to the details above, because various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An apparatus for dispensing liquids, comprising:

a. A container, suitable for dispensing liquids, with one or more cavities molded into the container;

b. A plate with one or more arms which detachably engage the cavity or cavities on the container, where the plate can be permanently attached to a wall;

c. A mechanism, attached to the plate, which permits the container to be securely locked to the plate.

2. An apparatus for dispensing liquids, comprising:

a. A container, suitable for dispensing liquids, with one or more cavities molded into the container;

b. A pump top which detachably engages the container;

c. An eyelet on the bottom of the container;

d. A plate with one or more arms which detachably engage the cavity or cavities on the container, where the plate can be permanently attached to a wall;

e. A mechanism, attached to the plate, which securely engages the eyelet on the container;

f. A device which detachably engages the pump top, and which can be securely attached to the eyelet on the container and the mechanism attached to the plate.

3. The apparatus for dispensing liquids of claim 2, where the mechanism attached to the plate is comprised of a pair of hollow attachments disposed along one edge of the plate such that the eyelet on the container will just fit into a gap between said attachments and allow a rod to pass through the attachments and the eyelet.

4. The apparatus for dispensing liquids of claim 2, where the device which detachably engages the pump top is a flexible strap having, at one end, an opening sized so that the opening will partially, but not completely, pass over the pump top, and having, at the other end, an opening which will just fit over the eyelet on the container.

5. The apparatus for dispensing liquids of claim 3, where the device which detachably engages the pump top is a flexible strap having, at one end, an opening sized so that the opening will partially, but not completely, pass over the pump top, and having, at the other end, an opening which will just fit over the eyelet on the container.

* * * * *